United States Patent [19]

Grims et al.

[11] Patent Number: 4,843,863

[45] Date of Patent: Jul. 4, 1989

[54] CONTAINER BODY MAKER DIE

[75] Inventors: Conrad M. Grims; Bruce A. Moen, both of Golden, Colo.

[73] Assignee: Adolph Coors Company, Golden, Colo.

[21] Appl. No.: 181,713

[22] Filed: Apr. 14, 1988

[51] Int. Cl.[4] ..... B21D 22/28

[52] U.S. Cl. ..... 72/349; 72/465

[58] Field of Search ..... 72/347, 349, 465; 83/640, 641

[56] References Cited

U.S. PATENT DOCUMENTS

| | | | |
|---|---|---|---|
| 1,977,327 | 10/1934 | Smith | 72/349 |
| 3,656,335 | 4/1972 | Kaminski . | |
| 3,735,629 | 5/1973 | Paramonoff . | |
| 3,943,740 | 3/1976 | Bartenstein . | |
| 4,173,882 | 11/1979 | Lee, Jr. | 72/349 |
| 4,179,909 | 12/1979 | Maeder . | |
| 4,183,237 | 1/1980 | Schaffer . | |
| 4,193,279 | 3/1980 | Maeder . | |
| 4,300,375 | 11/1981 | Maeder et al. . | |
| 4,554,815 | 11/1985 | Weishalla . | |

*Primary Examiner*—Lowell A. Larson

*Attorney, Agent, or Firm*—Klaas & Law

[57] ABSTRACT

Can ironing die members for use in a tool pack assembly which is part of a can body making apparatus used in forming cups into can bodies and wherein each can ironing die member is mounted in a fixedly mounted holding means so that the can ironing die member can be moved by the cup from an initial location to a new location if the longitudinal axes of the cup and the can ironing die member are not in alignment and retaining apparatus for retaining the can ironing die member at the new location until moved again by an out of alignment cup.

20 Claims, 4 Drawing Sheets

CONTAINER BODY MAKER DIE

FIELD OF THE INVENTION

This invention relates generally to tool pack assemblies which have ironing dies therein for ironing a cup into a container body and more specifically to ironing dies which have a longitudinal axis and are movably mounted for movement in radial directions so that they may be automatically centered by the cup.

BACKGROUND OF THE INVENTION

In the formation of containers, such as can bodies formed from aluminum, it is conventional to use a tool pack assembly in which are usually mounted a redraw assembly including a redraw die, a plurality of ironing die assemblies, a domer and a stripper assembly. In such a process, a ram is moved into the redraw assembly and has a cup positioned thereon and then moves through the ironing dies to have the can body formed. The length of the stroke of the ram through the tool pack assembly is fairly long so that substantial alignment problems occur. In many instances, self-centering means are provided wherein the ironing die assembly is movably mounted for movement in radial directions in response to the location of the cup and the ram but also the self-centering means will move the ironing die assembly back to its original position when the external forces of the cup and the ram are removed. If the ram moves slightly out of alignment, this results in the movement of the ironing die assembly during each stroke of the ram so as to produce substantial wear and tear on the ironing die assembly. This wear and tear causes the shut down of the can body making system so that worn ironing die assemblies can be replaced by new ironing die assemblies.

BRIEF SUMMARY OF THE INVENTION

This invention provides apparatus wherein tool member means, such as ironing die means, are supported by holding means so that a workpiece, such as a cup to be formed into a can body, may be moved through the tool member means so that during movement of the workpiece through the tool member means, the longitudinal axes of the tool member means and the workpiece coincide. The tool member means are movably mounted for movement in radial directions from an initial location to a new location in response to forces exerted thereon by the workpiece. This occurs when the longitudinal axes of the tool member means and the workpiece do not coincide when the workpiece initially contacts the tool member means so that the workpiece exerts a radially directed force on the tool member means to move it to a new location so that the longitudinal axes thereof coincide and retaining means are provided for retaining the tool member means in the new location.

In the preferred embodiment of the invention, the apparatus forms a part of a tool pack assembly for a body making apparatus wherein a cup is formed into a can body which apparatus usually includes a redraw assembly, can ironing die assemblies, a domer and a stripper assembly. This invention is directed to ironing die assemblies which are located in an elongated hollow housing having a longitudinal axis. Similar structures may be used for the redraw die. Adjustable support means are connected to the hollow elongated housing and have portions thereof located within the hollow elongated housing. Three holding means are provided and each of which receives and supports a workpiece engaging tool member means such as a can ironing die means with the holding means being supported on the adjustable support means so that the holding means and the can ironing die means are located within the hollow elongated housing. The holding means and the can ironing die means each have a longitudinal axis extending generally parallel to the longitudinal axis of the hollow elongated housing. Each of the can ironing die means has a die member for contacting the workpiece such as a cup to be formed into a can body. Each die member of can ironing die means is of a different size. Each holding means is provided with movement permitting means for receiving and supporting a can ironing die means so that the can ironing die means is capable of radial movement in any direction relative to the longitudinal axis thereof whenever a sufficient radially directed force is applied thereto. Movable ram means support the cup and are positioned to move the cup through the can ironing die means so as to form the cup into a can body wherein each of the ram means and the cup have a longitudinal axis. Means are provided to prevent radial and longitudinal movement of the holding means. The support means are initially adjusted when in a static condition so that the longitudinal axis of the can ironing die means is in axial alignment with the longitudinal axis of the ram means. If the longitudinal axis of the cup does not coincide with the longitudinal axis of any of the can ironing die means, the cup will apply sufficient force in a radial direction to such can ironing die means to move such can ironing die means in radial directions to a new location wherein the longitudinal axes of the can ironing die means and the cup coincide. Retaining means are provided for retaining the can ironing die means at the new location until such can ironing die means is moved again by a misaligned cup. In the preferred embodiment of the invention, the retaining means comprises friction producing means for producing frictional contact between the holding means and the can ironing die means comprising a radially extending surface on the holding means and a radially extending surface on the can ironing die means opposite thereto and resilient means for urging the radially extending surfaces of the holding means and the can ironing die means into contact with each other. In another embodiment of the invention, the retaining means comprises a plurality of piston means mounted in the holding means to provide for reciprocal sliding movement of the piston means in radial directions with a portion of the piston means being in contact with a generally cylindrical outer surface of the can ironing die means and a pressure equilibrium system is provided for applying equal amounts of pressure to each of the piston means so that when the can ironing die means is moved to a new location, it will remain thereat until acted on again.

BRIEF DESCRIPTION OF THE DRAWINGS

An illustrative and presently preferred embodiment of the invention is shown in the accompanying drawings in which.

DETAILED DESCRIPTION OF THE INVENTION

Figure 1:
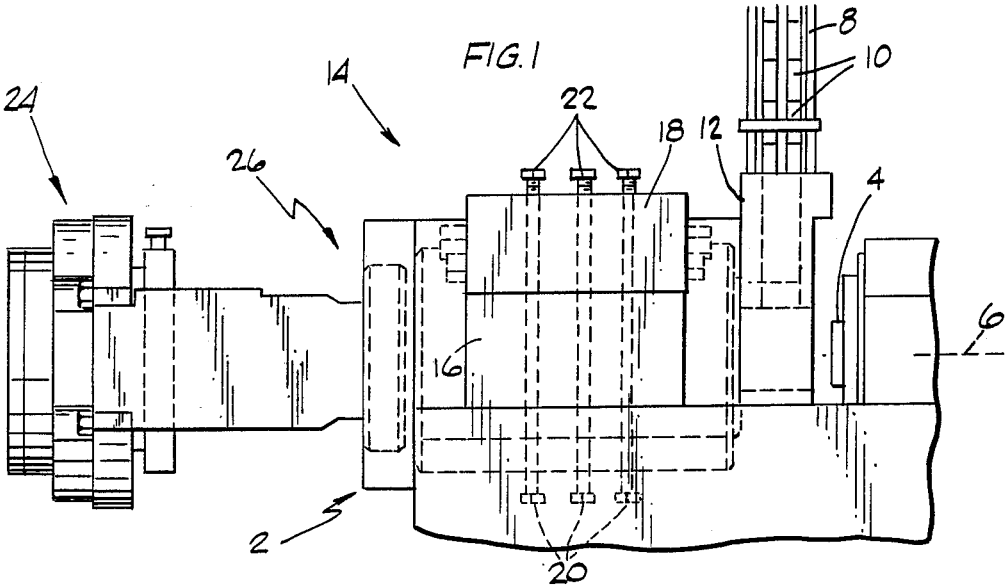
FIG. 1 is a schematic illustration of a portion of a can body making machine.

In FIG. 1, there is illustrated a conventional can body maker apparatus. The can body maker 2 which has conventional drive means (not shown) for reciprocating a ram means 4 along its longitudinal axis 6. A conveyor means 8 supports a continuous supply of cups 10 for movement thereof and delivery to a redraw assembly 12. A tool pack assembly 14 is connected to the redraw assembly 12 by conventional means and comprises an elongated housing 16 having a cover means 18 removably secured thereto by conventional means. Adjustable support means 20 have portions thereof located within the elongated housing 16 and clamping means 22 have portions located within the cover means 18 for purposes described below. Can bottom doming means 24 are connected to the tool pack assembly by conventional means and include can body stripping means 26 for stripping the formed can body from the ram means 4 during the return stroke thereof.

Figure 2:
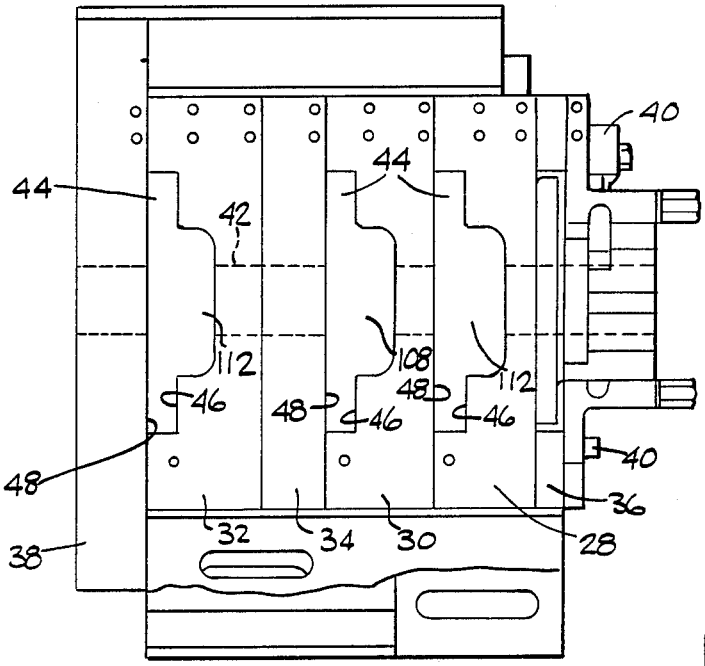
FIG. 2 is a top plan view of the housing for holding the can ironing die means.

The elongated housing 16 is illustrated more specifically in FIG. 2 and comprises a plurality of plate member means 28, 30 and 32, a spacer member 34 between the plate member means 30 and 32 and end plates 36 and 38, all of which are held in assembled relationship by conventional means such as a plurality of bolts 40. A central opening 42 extends through the elongated housing 16. Each of the plate member means 28, 30 and 32 has slot means 44 having facing wall portions 46 and 48 for purposes described below.

Figure 5:
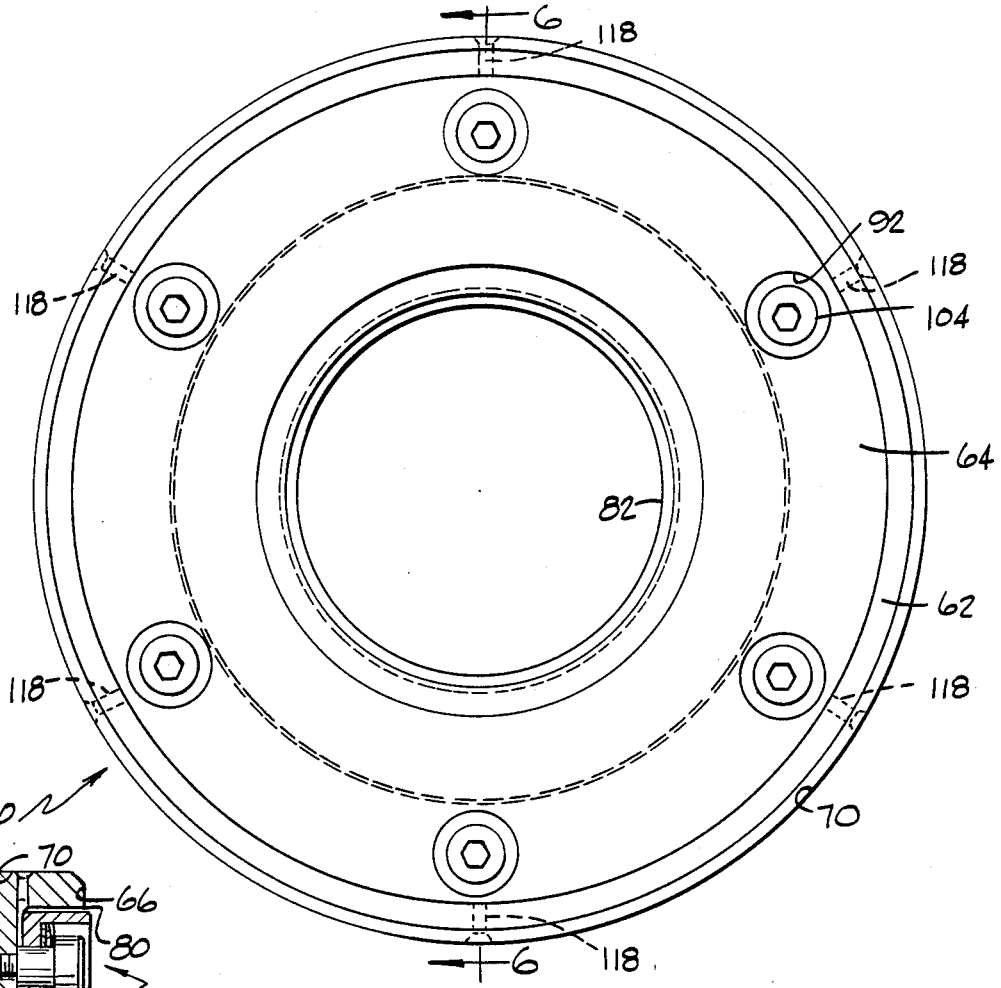
FIG. 5 is a front elevational view of a holding means and a can ironing die means.
Figure 6:
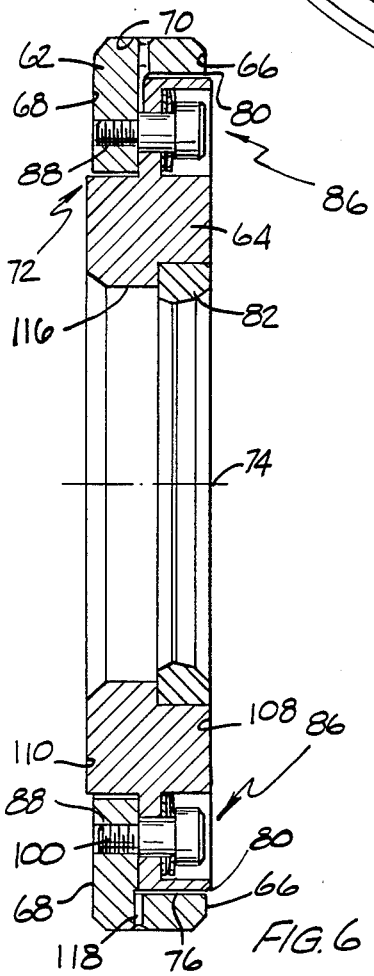
FIG. 6 is a cross-sectional view taken on the line 6—6 of FIG. 5.
Figure 7:
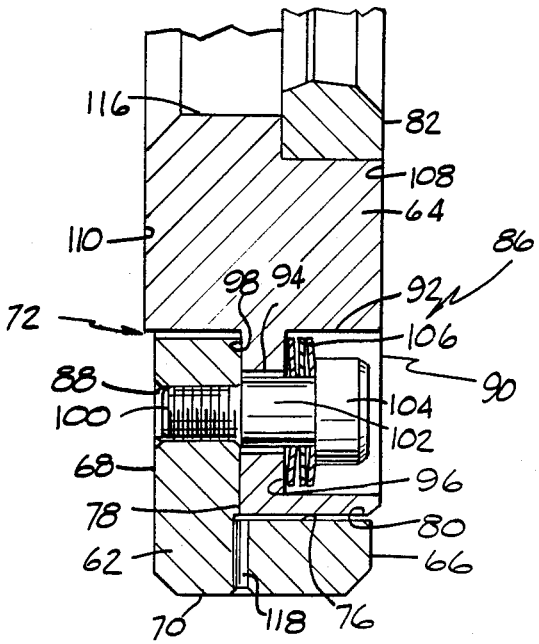
FIG. 7 is an enlarged view of a portion of FIG. 6.

In FIGS. 5–7, there is illustrated a work engaging tool member means 60 of this invention comprising holding means 62 and can ironing die means 64. The holding means 62 has a front surface 66, a rear surface 68, a peripheral surface 70, a central opening 72 and a longitudinal axis 74. A recess is formed in the front surface 66 and comprises a generally cylindrical inner surface 76 and a radially extending surface 78 extending between the central opening 72 and the generally cylindrical inner surface 76. The can ironing die means 64 has a generally cylindrical outer surface 80 radially opposite to the generally cylindrical inner surface 76. The diameter of the generally cylindrical inner surface 76 is greater than the diameter of the generally cylindrical outer surface 80 to provide movement permitting means to allow relative radial movement in any direction between the holding means 62 and the can ironing die means 64. A conventional die member 82 is mounted in the can ironing die means 64.

The can ironing die means 64 is mounted in the recess in the holding means 62 by retaining means 86 which permits the relative movement between the holding means 62 and the can ironing die means 64 when a sufficient radially directed force is applied to the can ironing die means 64 by the cup 10 so as to move the can ironing die means 64 from an initial location to a new location wherein the axes of the cup 10 and can ironing die means 64 coincide but functions to hold the can ironing die means 64 at the new location. The retaining means 86 includes a plurality of spaced apart threaded openings 88 in the radially extending surface 78 and a plurality of spaced apart bore means 90, FIG. 7, in the can ironing die means 64. Each of the bore means 90 has a first bore portion 92 having a relatively large cross-sectional configuration, preferably cylindrical, and a second bore portion 94 having a relatively small cross-sectional configuration, preferably cylindrical, so as to form an annular shoulder 96. The can ironing die means 64 has a radially extending surface 98 axially opposite to the radially extending surface 78. Bolt means having a threaded end 100 for engagement in the threaded openings 88, a central unthreaded portion 102 and an enlarged head portion 104 are secured in the threaded openings 88. The central portion 102 is generally cylindrical and has a diameter less than the diameter of the second bore portion 94 to allow for the relative radial movement between the holding means 62 and the can ironing die means 64. Spring means 106, such as a belleville spring, are mounted on the central portion 102 and are located between the annular shoulder 96 and the enlarged head portion 104. The bolt means are threaded into the threaded openings 88 so that the spring means 106 urges the radially extending surfaces 78 and 98 into engagement with each other so that frictional forces therebetween function to prevent relative movement therebetween unless a sufficient amount of force is applied to the can ironing die means 64 to overcome such frictional forces.

Figure 3:
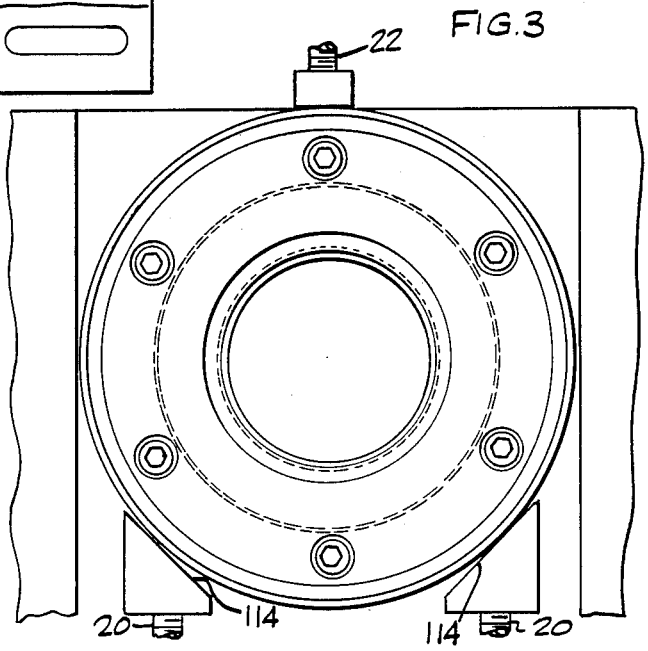
FIG. 3 is an elevational view illustrating the support means for supporting the holding means for the can ironing die means.
Figure 4:
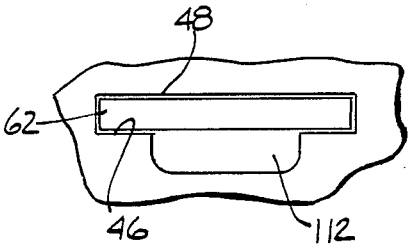
FIG. 4 is a partial top plan view illustrating the location of the holding means in the housing.

The mounting of the holding means 62 and the can ironing die means 64 in the elongated housing 16 is illustrated in FIGS. 3 and 4. The holding means 62 is inserted into one of the slot means 44 so that the front and rear surfaces 108 and 110 of the ironing die means 64 are substantially in contact with the wall portions 46 and 48 so as to prevent axial movement of the holding means 62. A cavity 112 is provided so that a hand or a removal tool may be used to remove the holding means 62 from the slot means 44. The holding means 62 is inserted into the slot means 44 until it makes contact with the support surfaces 114 of the adjustable support means 20 which are then operated to position the longitudinal axis 74 of the can ironing die means 64 in alignment with the longitudinal axis of the ram means 4. After a holding means 62 has been inserted into each of the slots 44 of the plate member means 28, 30 and 32, the cover means 18 is attached to the elongated housing 16 and the clamping means 22 are actuated to clamp the holding means 62 between the clamping means 22 and the support surfaces 114 so as to prevent radial movement of the holding means 62. The diameter of the central opening 42 is greater than the diameter of the cylindrical inner surface 116 of the can ironing die means 64. The axial distance between each of the can ironing die means 64 in the plate member means 28 and 30 is less than the axial distance between each of the can ironing die means in the plate member means 30 and 32. A plurality of radially extending passageways 118 are formed in the holding means 62 for the expulsion of sludge.

In operation, a holding means 62 and a can ironing die means 64 is placed in each of the plate member means 28, 30 and 32 and secured therein with the die member 82 having the largest diameter in the plate member means 28, the die member 82 having a smaller diameter in the plate member means 30 and the die member 82 having the smallest diameter in the plate member means 32. The ram means 4 is moved into the redraw assembly 12 where it picks up a cup 10 and moves it into the can ironing die means 64 in the plate member means 28. If the longitudinal axes of the cup 10 and the can ironing die means 64 coincide, no radial movement of the can ironing die means 64 occurs. If the longitudinal axes of the cup 10 and the can ironing die means 64 do not coincide, the cup 10 exerts sufficient radially directed force on the can ironing die means 64 to move them in a radial direction to a new location whereat the longitudinal axes of the cup 10 and the can ironing die means 64 do coincide. The retaining means holds the can ironing die means 64 at the new location. These operations are repeated at the plate member means 30 and 32 as the ram means 4 moves the cup 10 through the can ironing die means 64 in each of these plate member means.

In one tool pack assembly 14, the die member 82 in the can ironing die means 64 in the plate member means 28 has a diameter of about 2.4901 inches and the generally cylindrical outer surface 80 has a diameter of about 5.500 inches and the diameter of the generally cylindrical inner surface 76 has a diameter of about 5.520 inches so as to allow for radial movement therebetween of about ±0.010 inch. The diameter of the second bore portion 94 is about 0.290 inch and the diameter of the central portion 102 is about 0.250 inch so as to allow for radial movement therebetween of about ±0.020 inch.

The die member 82 in the can ironing die means 64 in the plate member means 30 has a diameter of about 2.4873 inches and the generally cylindrical outer surface 80 has a diameter of about 5.500 inches and the diameter of the generally cylindrical inner surface 76 has a diameter of about 5.515 inches so as to allow for radial movement therebetween of about ±0.0075 inch. The diameter of the second bore portion 94 is about 0.290 inch and the diameter of the central portion 102 is about 0.250 inch so as to allow for amount radial movement therebetween of about ±0.020 inch.

The die member 82 in the can ironing die means 64 in the plate member means 32 has a smallest diameter of about 2.4817 inches and the generally cylindrical outer surface 80 has a diameter of about 5.500 inches and the diameter of the generally cylindrical inner surface 76 has a diameter of about 5.510 inches so as to allow for radial movement therebetween of about 0.0005 inch. The diameter of the second bore portion 94 is about 0.290 inch and the diameter of the central portion 102 is about 0.250 inch so as to allow for amount radial movement therebetween of about ±0.020 inch.

Figure 8:
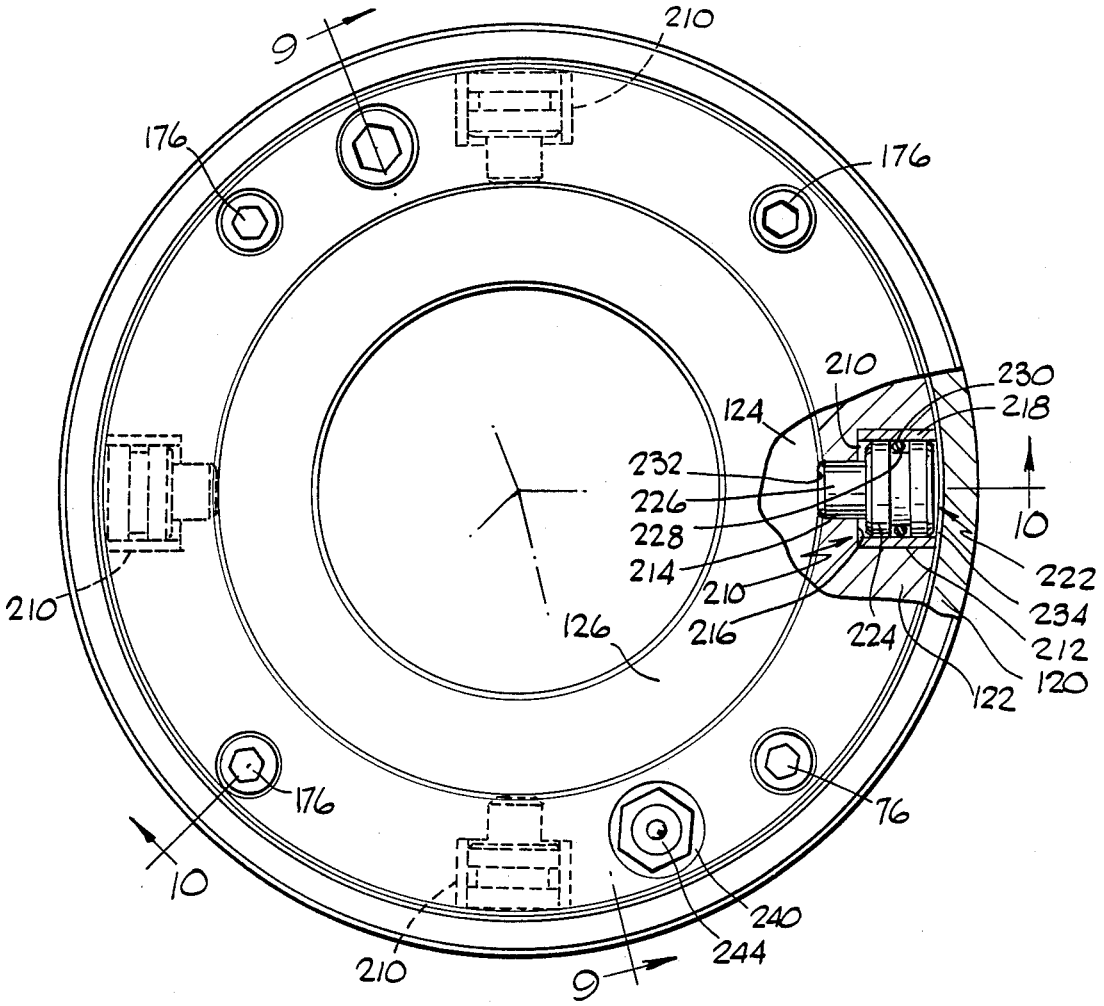
FIG. 8 is a front elevational view of another embodiment of the invention.
Figure 9:
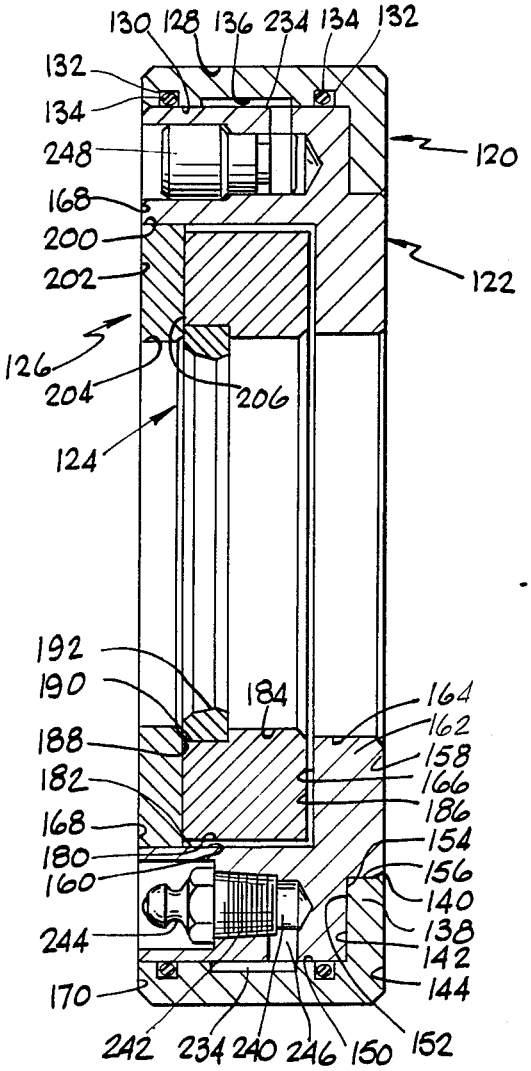
FIG. 9 is a cross-sectional view taken on the line 9—9 of FIG. 8.
Figure 10:
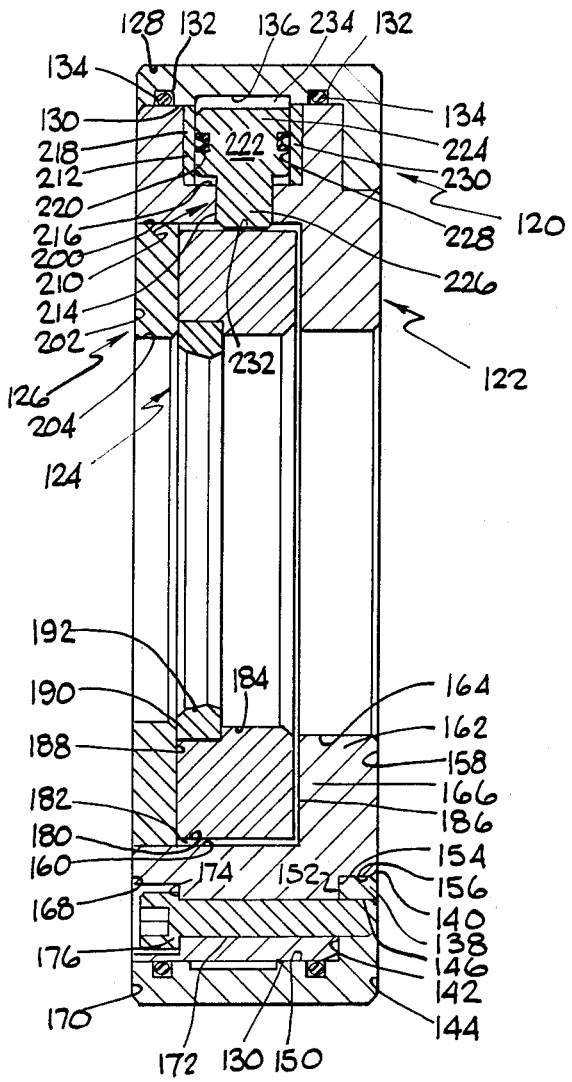
FIG. 10 is a cross-sectional view taken on the line 10—10 of FIG. 8.

Another embodiment of the invention is illustrated in FIGS. 8–10 and comprises an outer housing 120, a holding means 122, a can ironing die means 124 and a retaining means 126. The outer housing 120 has a generally cylindrical outer surface 128 and a generally cylindrical inner surface 130. A pair of spaced apart annular grooves 132 are formed in the inner surface 130 and an 0-ring sealing means 134 is located in each of the grooves 132 for purposes described below. Another annular groove 136 is formed in the inner surface 130 and extends in an axial direction for a substantially greater distance than its extent in a radial direction for purposes described below. An annular flange 138, lower portion of FIGS. 9 and 10, projects radially inwardly from the inner surface 130 and has a generally cylindrical inner surface 140 and a generally planar inner surface 142 extending in a radial direction and a generally planar outer surface 144. A plurality of spaced apart threaded openings 146 are formed in the planar inner surface 142.

The holding means 122 has a generally cylindrical outer surface 150, lower portion of FIGS. 9 and 10, having a diameter only slightly less than the diameter of the inner surface 130 for mating engagement therewith. The 0-ring sealing means 134 functions to form seals between the inner surface 130 and the outer surface 150. An annular inwardly directed recess 152 is formed in the outer surface 150 and has a generally planar surface 154 extending in a radial direction for mating engagement with the planar surface 142 and a generally cylindrical surface 156 for mating engagement with the cylindrical surface 140. The holding means 122 has a generally planar outer surface 158 extending in a radial direction and lying in the same plane as the planar outer surface 144. The holding means 122 has a generally cylindrical inner surface 160. An annular flange 162 projects radially inwardly from the inner surface 160 and has a generally cylindrical inner surface 164 and a generally planar inner surface 166 extending in a radial direction. The holding means 122 has a generally planar outer surface 168 extending in a radial direction and lying in the same plane as a generally planar outer surface 170 on the outer housing 120. The holding means 122 is provided with a plurality of spaced apart bore means 172 having shoulders 174 so that threaded bolts 176 may be threaded into the threaded openings 146 to secure the holding means 122 onto the outer housing 120.

The container ironing die means 124 has a generally cylindrical outer surface 180 having a diameter smaller than the diameter of the inner surface 160 so that an annular space 182 exists therebetween and a generally cylindrical inner surface 184. The container ironing die means 124 has a generally planar outer surface 186 extending in a radial direction and adapted to mate with the generally planar surface 166 and a generally planar outer surface 188 extending in a radial direction. A recess 190 is formed in the inner surface 184 and a die member 192 is secured in the recess 190 in a conventional manner.

The retaining means 126 has a generally cylindrical outer surface 200 having a diameter only slightly smaller than the diameter of the inner surface 160 so that the retaining means 126 is snugly received therein. The retaining means 126 has a generally planar outer surface 202 extending in a radial direction and when the retaining means 126 has been inserted into the holding means 122, the planar surfaces 170, 168 and 202 lie in the same plane. The retaining means also has a generally cylindrical inner surface 204 and a generally planar surface 206 so that the container ironing die means 124 is contained between the planar surfaces 166 and 206 in a manner to permit movement of the container ironing die means 124 in radial directions for purposes described below.

The holding means 122 is provided with a plurality of spaced apart radially extending bore means 210, FIGS. 8 and 10, each of which having a first section 212 having a relatively large cross-sectional configuration and a second section 214 having a relatively small cross-sectional configuration so as to form a shoulder 216 therebetween. The first and second sections 212 and 214 preferably have cylindrical cross-sectional configurations. An insert sleeve 218 having a generally cylindrical inner surface 220 is secured in the first section 214 and the diameter of the inner surface 220 is greater than the diameter of the second section 214. A piston 222 is mounted for reciprocal sliding movement in the bore means 210 and has a first portion 224 located in the first section 212 and a second portion 226 located in the second section 214. The first portion 224 has an annular groove 228 therein in which is seated a cup washer 230 for providing a seal between the first portion 224 and the inner surface 220 but permitting the reciprocal sliding movement of the piston 222. The second portion 226 has an outer end surface 232 adapted to contact the generally cylindrical outer surface 180 of the container ironing die means 124. The outer surface 150 of the holding means 122 cooperates with the annular groove 136 to form an annular space 234 therebetween. The first section 212 is in fluid communication with the annular space 234.

The holding means 122 is provided with an axially extending opening 240 having a threaded portion 242 in which is mounted a leakproof zerk fitting 244. The opening 240 connects with a passageway 246 which is in fluid communication with the annular space 234. An oil or grease supply means (not shown) is connected to the leakproof zerk fitting 244 and oil or grease is pumped therethrough into the annular space 234. Sufficient oil or grease is pumped into the annular space 234 so that it will flow into each of the first sections 212 and move each of the outer surface portions 232 of the pistons 222 into contact with the generally cylindrical outer surface 18 of the container ironing die means 124. Sufficient oil or grease is pumped into the annular space 234 until an equilibrium condition is reached and each of the outer surface portions 232 is exerting the same pressure against the cylindrical outer surface 180. A pressure relief valve 248 is secured in the holding means 122 and is in fluid communication with the annular space 234 to ensure that sufficient pressure exists therein to maintain the equilibrium condition.

In operation, the outer housing 120 and the holding means 122 are mounted in a fixed location so that the ram means 4 with a can blank 10 thereon can be moved through the can ironing die means 124. If the longitudinal axes of the can blank 10 and container ironing die means 124 coincide, no radial movement of the can ironing die means 124 occurs. If the longitudinal axes of the can blank 10 and the can ironing die means 124 do not coincide, the can blank 10 will exert sufficient force against the can ironing die mean 124 to move it in a radial direction to a new location whereat the longitudinal axes of the can blank 10 and the can ironing die means 124 do coincide. Since the pressure exerted by each of the outer surface portions 232 on the generally outer surface 180 is the same, the can ironing die means 124 will remain at the new location until another moving force is applied thereto.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. Apparatus for use in positioning a tool member means for contacting a workpiece which is moved through the tool member means by ram means comprising:

an elongated hollow housing having a central opening extending therethrough and a longitudinal axis;

adjustable support means connected to said elongated hollow housing and having portions thereof located within said elongated hollow housing;

at least one workpiece engaging tool member means for performing operations on a workpiece and having a longitudinal axis;

at least one holding means for receiving and supporting said workpiece engaging tool member means and having a longitudinal axis;

said holding means being supported on said adjustable support means so that said holding means and said workpiece engaging tool member means are located within said elongated hollow housing;

clamping means for cooperation with said support means to prevent movement of said holding means in radial directions;

movement permitting means cooperating with said holding means and said workpiece engaging tool member means so that said work engaging tool member means is capable of radial movement in any direction relative to said longitudinal axis thereof when a sufficient radially directed force is applied thereto;

movable ram means for supporting said workpiece and moving said workpiece through said central opening in said workpiece engaging tool member means, said movable ram means and said workpiece each having a longitudinal axis;

stop means for limiting movement of said workpiece engaging tool member means in directions parallel to said longitudinal axis thereof;

said adjustable support means being initially adjusted to hold said workpiece engaging tool member means with said longitudinal axis thereof in axial alignment with said longitudinal axis of said ram means;

said workpiece applying a radially directed force to said workpiece engaging tool member means when being moved by said ram means through said workpiece engaging tool member means if said longitudinal axis of said workpiece engaging tool member means is not in coaxial relationship with said longitudinal axis of said workpiece to move said workpiece engaging tool member means in at least one radial direction to a new location wherein said longitudinal axes of said workpiece engaging tool member means and said workpiece are in a coaxial relationship; and retaining means for retaining said workpiece engaging tool member means at said new location until it is moved again by an out of alignment workpiece.

2. Apparatus as in claim 1 wherein said at least one workpiece engaging tool member means comprises:

a plurality of workpiece engaging tool member means.

3. Apparatus as in claim 2 wherein said plurality of workpiece engaging tool member means comprises:

at least three workpiece engaging tool member means.

4. Apparatus as in claim 1 wherein said stop means comprises:

wall means defining an open ended compartment dimensioned to receive said workpiece engaging tool member means to limit movement thereof in longitudinal directions.

5. Apparatus as in claim 1 and further comprising:

said holding means having a front surface, a rear surface, a peripheral surface and a longitudinal axis;

said holding means having a central opening extending therethrough;

a recess in said front surface extending in a longitudinal direction toward said back surface; and said movement permitting means comprising mounting means for mounting said workpiece engaging tool member means in said recess so as to permit limited movement of said workpiece engaging tool member means in said radial directions.

6. Apparatus as in claim 5 wherein said movement permitting means comprises:

said recess having a generally cylindrical inner surface extending in a longitudinal direction;

said workpiece engaging tool member means having a generally cylindrical outer surface radially opposite to said generally cylindrical inner surface of said recess; and said generally cylindrical inner surface of said recess having a diameter greater than the diameter of said generally cylindrical outer surface of said workpiece engaging tool member means.

7. Apparatus as in claim 6 wherein said retaining means comprises:

friction producing means for producing frictional contact between said holding means and said workpiece engaging tool member means.

8. Apparatus as in claim 7 wherein said friction producing means comprises:

said recess having a radially extending surface extending between said central opening and said generally cylindrical inner surface of said recess;

said workpiece engaging tool member means having a radially extending surface longitudinally opposite to said radially extending surface of said recess; and resilient means for urging said radially extending surfaces of said workpiece engaging tool member means and said recess into contact with each other.

9. Apparatus as in claim 8 wherein said resilient means comprises:

a plurality of spaced apart threaded openings in said radially extending surface of said recess;

a plurality of spaced apart bore means extending through said workpiece engaging tool member means and having openings in said radially extending surface of said workpiece engaging tool member means;

each of said bore means including a first bore portion having a relatively large cross-sectional configuration and a second bore portion having a relatively small cross-sectional configuration with said second bore portion having an opening in said radially extending surface of said workpiece engaging tool member means;

a shoulder formed at the junction of said first and second bore portions;

a threaded bolt extending through each of said bore means with the threaded bolt being threadedly engaged with one of said threaded openings;

an enlarged head on each of said bolts; and spring means between said enlarged head and said shoulder to urge said radially extending surfaces of said workpiece engaging tool member means and said recess into contact with each other to provide said friction producing means.

10. Apparatus as in claim 9 wherein said at least one workpiece engaging tool member means comprises:

a plurality of workpiece engaging tool member means.

11. Apparatus as in claim 10 wherein said plurality of workpiece engaging tool member means comprises:

at least three workpiece engaging tool member means.

12. Apparatus as in claim 11 wherein:

said workpiece comprises a cup adapted to be formed into a can body;

each of said workpiece engaging tool member means comprises a can ironing die means;

each of said can ironing die means having a generally cylindrical inner edge for contacting said cup; and said generally cylindrical inner edges of said can ironing die means are of different diameters.

13. A can ironing die assembly for use in a tool pack assembly for a can body making machine in which a ram means moves a cup, having a longitudinal axis, through the can ironing die assembly comprising:

can ironing die means having a longitudinal axis;

said can ironing die means having a die member mounted therein and having a longitudinal axis coinciding with said longitudinal axis of said can ironing die means;

holding means adapted to be secured at a fixed location;

said holding means receiving and supporting said can ironing die means;

movement permitting means for cooperating with said holding means and said can ironing means so that said can ironing means is capable of radial movement in an direction relative to said longitudinal axis thereof in response to a radially directed force applied thereto;

said cup applying a radially directed force to said can ironing die means when being moved through said can ironing die means if said longitudinal axes of said cup and said can ironing die means do not coincide to move said can ironing means in at least one radial direction to a new location wherein said longitudinal axes of said cup and said can ironing die means do coincide; and retaining means for retaining said can ironing die means at said new location until it is moved again by an out of alignment cup.

14. The invention as in claim 13 and further comprising:

said holding means having a front surface, a rear surface, a peripheral surface and a longitudinal axis;

said holding means having a central opening extending therethrough;

a recess in said front surface extending in a longitudinal direction toward said back surface;

said recess having a generally cylindrical inner surface extending in a longitudinal direction;

said can ironing die means having a generally cylindrical outer surface radially opposite to said generally cylindrical inner surface of said recess; and said generally cylindrical inner surface of said recess having a diameter greater than the diameter of said generally cylindrical outer surface of said can ironing die means.

15. The invention as defined in claim 14 wherein said retaining means comprises:

said recess having a radially extending surface extending between said central opening and said generally cylindrical inner surface of said recess;

said can ironing die means having a radially extending surface longitudinally opposite to said radially extending surface of said recess; and resilient means for urging said radially extending surfaces of said can ironing means and said recess into frictional engagement with each other.

16. The invention as defined in claim 15 wherein said resilient means comprises:

a plurality of spaced apart threaded openings in said radially extending surface of said recess;

a plurality of spaced apart bore means extending through said can ironing die means and having openings in said radially extending surface of said work engaging tool member means;

each of said bore means including a first bore portion having a relatively large cross-sectional configuration and a second bore portion having a relatively small cross-sectional configuration with said second bore portion having an opening in said radially extending surface of said can ironing die means;

a shoulder formed at the junction of said first and second bore portions;

a threaded bolt extending through each of said bore means with the threaded bolt being threadedly engaged with one of said threaded openings;

an enlarged head on each of said bolts; and spring means between said enlarged head and said shoulder to urge said radially extending surfaces of said can ironing die means and said recess into contact with each other to provide said friction producing means.

17. The invention as defined in claim 13 and further comprising:

an outer housing adapted to be mounted at a fixed location;

mounting means cooperating with said outer housing and said holding means to mount said holding means at a fixed location on said outer housing;

said holding means having at least one generally cylindrical inner surface having a longitudinal axis;

said can ironing die means having at least one generally cylindrical outer surface radially opposite to said at least one generally cylindrical inner surface of said holding means; and said at least one generally cylindrical inner surface of said holding means having a diameter greater than said at least one generally cylindrical outer surface of said can ironing die means to provide for said radial movement of said can ironing die means.

18. The invention as defined in claim 17 wherein said retaining means comprises:

a plurality of piston means mounted in said holding means to provide for reciprocal sliding movement thereof in radial directions;

said piston means being equidistantly spaced apart;

each of said piston means having a portion thereof in contact with said at least one generally cylindrical outer surface of said can ironing die means; and a pressure equilibrium system for applying equal amounts of pressure to each of said piston means so that when said can ironing die means is moved to a new location, it will remain thereat until acted on again.

19. The invention as defined in claim 18 wherein said pressure equilibrium system comprises:

said outer housing having at least one generally cylindrical inner surface;

said holding means having at least one generally cylindrical outer surface radially opposite to said at least one generally cylindrical surface of said outer housing;

an annular space formed between said at least one generally cylindrical inner surface of said outer housing and said at least one generally outer cylindrical surface of said holding means;

spaced apart annular sealing means for forming a seal between said at least one generally cylindrical inner surface of said outer housing and said at least one generally cylindrical outer surface of said holding means and located on either axial side of said annular space;

a plurality of bore means extending through said outer housing in a radial direction and spaced equidistantly apart;

each of said piston means being located in one of said bore means;

each of said bore means having an opening in fluid communication with said annular space;

sealing means between each of said piston means and each of said bore means for forming a seal therebetween but permitting said reciprocal sliding movement of said piston means, said sealing means permitting a portion of said piston means to be in fluid communication with said annular space; and said annular space and said bore means being filled with a fluid under sufficient pressure to provide an equilibrium pressure system for applying equal amounts of pressure on each of said piston means.

20. The invention as defined in claim 19 wherein:

said bore means comprises a first section and a second section with said first section having a generally cylindrical inner surface and said second section having a generally cylindrical inner surface having a diameter smaller than the diameter of said generally cylindrical inner surface of said first section and with said section being located radially inwardly relative to said first section;

said piston means having a first portion and a second portion with said first portion having a generally cylindrical outer surface and being located in said first section of said bore means and said second portion having a generally cylindrical outer surface having a diameter smaller than the diameter of said generally cylindrical outer surface of said first portion and being located in said second section of said bore means; and said sealing means being located between said generally cylindrical inner surface of said first section and said generally cylindrical outer surface of said first portion.

* * * * *